US005322448A

United States Patent [19]

Hahn

[11] Patent Number: 5,322,448

[45] Date of Patent: Jun. 21, 1994

[54] ELECTRICAL CONNECTOR ASSEMBLY

[75] Inventor: Joachim A. Hahn, Schmitten, Fed. Rep. of Germany

[73] Assignee: The Whitaker Corporation, Wilmington, Del.

[21] Appl. No.: 12,101

[22] Filed: Feb. 1, 1993

[30] Foreign Application Priority Data

Feb. 17, 1992 [GB] United Kingdom ..... 9203346

[51] Int. Cl.[5] ..... H01R 13/62

[52] U.S. Cl. ..... 439/157; 439/153

[58] Field of Search ..... 439/152-160, 439/372

[56] References Cited

U.S. PATENT DOCUMENTS 4,152,038 5/1979 Inouye et al. ..... 439/157
4,241,966 12/1980 Gomez ..... 439/157
4,914,552 4/1990 Keemer ..... 439/157
5,163,847 11/1992 Regnier ..... 439/157

FOREIGN PATENT DOCUMENTS

0273999A2 3/1987 European Pat. Off. .
8714016 11/1987 Fed. Rep. of Germany .
2385239 3/1978 France .

*Primary Examiner*—David L. Pirlot
*Attorney, Agent, or Firm*—Adrian J. LaRue; Eric J. Groen

[57] ABSTRACT

An electrical connector assembly comprises a pin header connector and a socket connector for mating with the pin header connector. The pin header connector has a housing provided with a pair of opposed racks, the socket connector being provided with a pair of opposed levers each having a pinion. The levers can be swung by means of ganged handles to drive the socket connector into, and out of, mated relationship with the pin header connector. In the interest of simplifying the moulding of the pin header connector housing and of reducing its width, each rack projects above the upper edge of the pin header connector housing in substantially coplanar relationship with the respective side wall of that housing, the teeth of each rack overhanging the respective side wall.

9 Claims, 7 Drawing Sheets 40
42
46
49
48
50
44
52
51
2
23
13
8
16
32
30
30
25
30
32
32
14
24
24
20
10
20
34
36
34
34
38
36
34
36
34
38

28
40
42
22
25
12
8
19
18
2
24
24
20
20
26
14
16
28
32
42
32
25
32
10
24
40
13
34
30
30
34
30
34
24

ELECTRICAL CONNECTOR ASSEMBLY

BACKGROUND OF THE INVENTION

1. Field of the Invention

This invention relates to an electrical connector assembly comprising first and second mating electrical connectors, for example a pin header connector and a socket connector, having rack and pinion means for use in mating and unmating the connectors.

2. Description of the Prior Art

Such a connector assembly is known, for example, from DE-U-8714016.0, which assembly comprises first and second mating electrical connectors, the first connector having a first insulating housing and the second connector having a second insulating housing, the first housing having side walls defining a receptacle having a mouth for receiving the second housing in mating relationship with the first housing, the side walls of the first housing being formed with a pair of opposed racks, and side walls of the second housing having thereon a pair of opposed levers each having a pinion for meshing with teeth of a respective one of the racks, the levers being swingable drive the housings into, and out of, fully mating relationship, when the pinions are meshed with the racks.

Such an assembly is for use in a crowded environment, for example, beneath the dash panel of a vehicle, where access to the connector assembly may be difficult when the housings of the assembly are to be mated and unmated in the course of electrical repairs to be made to the vehicle.

In a known connector assembly of the kind defined above, the racks are incorporated into the inner surfaces of the side walls of the receptacle of the first insulating housing so that complex tooling is needed in order to form the racks when the housing is being moulded. Because of the presence of the racks in said side walls, the side walls are of substantial thickness so that the width of the housing is increased, which is disadvantageous when the connector assembly, or indeed a bank of such assemblies is to be mounted in a crowded environment.

SUMMARY OF THE INVENTION

According to one aspect of the present invention, a connector assembly as defined in the second paragraph of this specification, is characterised in that each rack upstands outwardly of the mouth of the receptacle from an edge of a respective side wall of the receptacle, the teeth of the rack overhanging that side wall and the rack being substantially coplanar therewith.

The racks can therefore readily be formed when the first housing is being moulded, without the use of complex tooling and the width of the housing is substantially reduced, for example, by some 40%. Since the second housing is received in the first housing, the overall width of the connector assembly is accordingly reduced.

The levers are preferably positioned on the side walls on the second insulating housing so that they remain above the receptacle side walls throughout the swinging movements of the levers, these side walls being provided with cut outs for accommodating the pinions. The overall height of the connector assembly is thereby reduced.

For reduced width of the connector assembly, the levers are preferably uniplanar and are substantially coplanar with the side walls of the receptacle when the second housing is received therein.

In order to prevent unauthorised tampering with the levers, when the connector assembly is sited in a motor vehicle for example, the levers may be provided with eyelets which are aligned with a further eyelet formed in a projection upstanding from the second housing, between the levers, all of the eyelets being aligned for the reception of a common wire in the fully mated position of the housings, the ends of the wire being sealed together, for example, by means of a lead seal, when the wire has been passed through the eyelets.

The second housing may be arranged exchangeably to receive an electrical connector member having terminals for mating terminals of the first connector, the connecter member and the second housing being provided with co-operating snap engagement means for retaining the connector member in the second housing, and cooperating polarising means for ensuring that only the correct connector member can be inserted in the second housing.

According to another aspect thereof, the present invention consists in an electrical connector assembly comprising a pin header connector and a socket connector for mating therewith, the pin header connector having a first insulating housing having a pair of side walls defining a receptacle and having upper edges defining a mouth for receiving the socket connector into the receptacle, in mating relationship with the pin header connector, with electrical pins of the pin header connector received in electrical socket terminals of the socket connector, the first housing being formed with a pair of opposed racks, the socket connector having a second housing in the form of a cover having side walls on which are mounted of opposed levers, each having a pinion for meshing with teeth of a respective one of the racks, the levers being swingable to drive the socket connector into, and out of, fully mated relationship with the pin header connector, when the pinions are meshed with teeth of the racks; characterised in that each rack is formed integrally with and upstands from the upper edge of the respective side wall of the first housing in substantially coplanar relationship with that side wall with the rack teeth of the rack overhanging such upper edge of that side wall, the levers being so vertically positioned on the side walls of the second housing that the levers remain above the side walls of the first housing throughout the swinging movements of these levers, these side walls being provided with cut outs for accommodating the pinions, each lever being uniplanar and being substantially coplanar with the respective side wall of the first housing when the second connector is received therein.

A pin header electrical connector assembly comprises a pin header connector 2 and a socket electrical connector 6, for mating with the connector 2.

Figure 1:
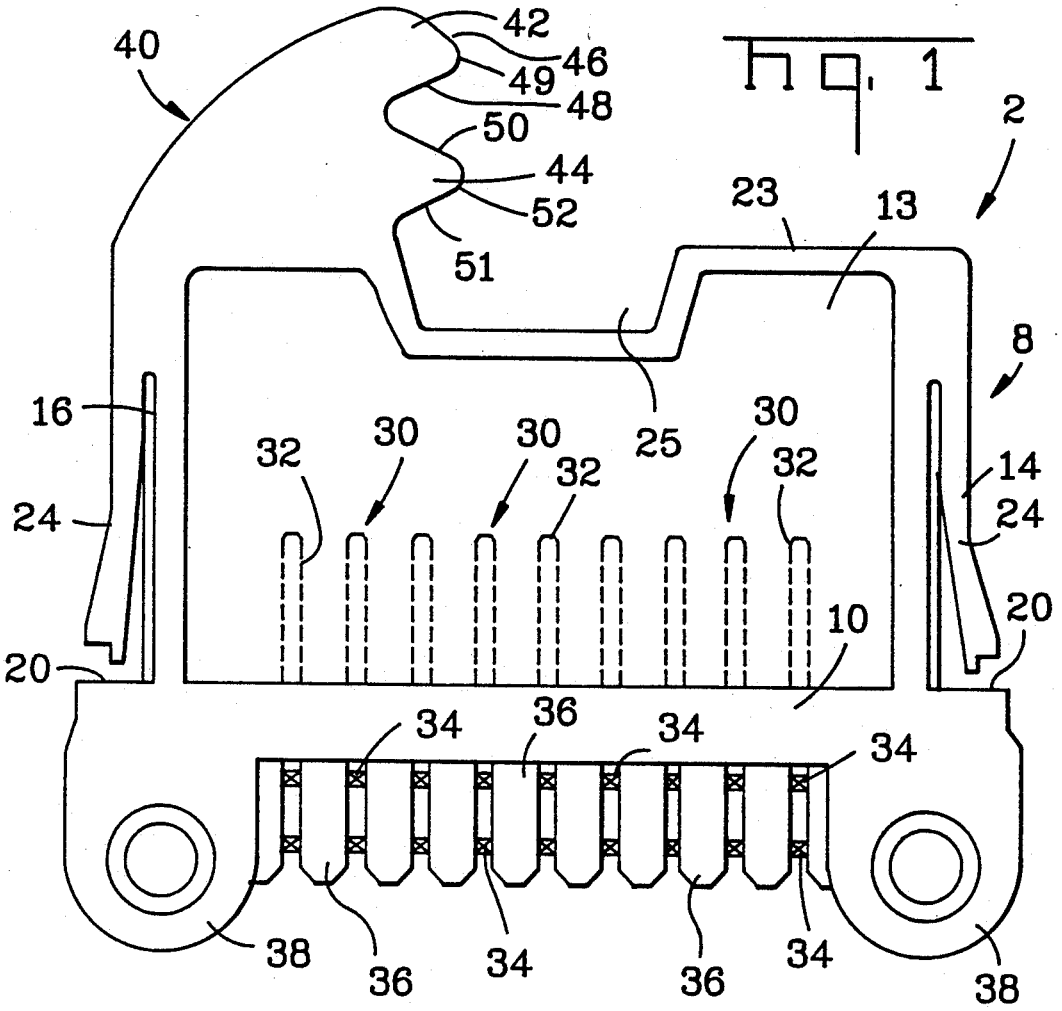
FIG. 1 is a side view of a pin header connector of a pin header electrical connector assembly.
Figure 2:
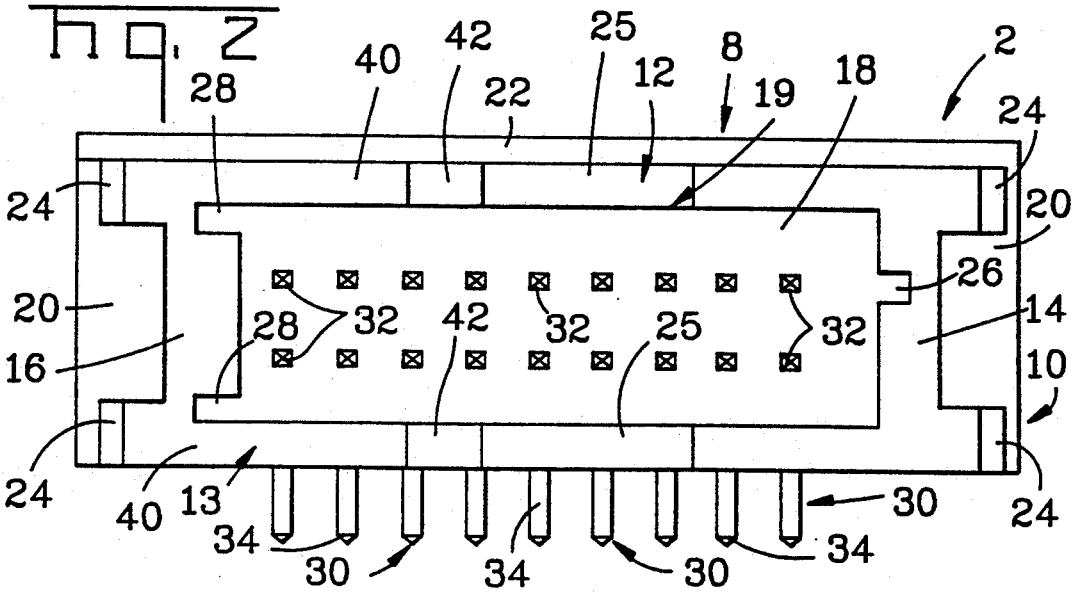
FIG. 2 is a top plan view of the pin header connector.

The connector 2, which is best seen in FIGS. 1 and 2, comprises a one piece, elongate, moulded insulating housing 8 having a base 10 from which upstand side walls 12 and 13 and end walls 14 and 16, co-operating to define a generally rectangular receptacle 18 having a mouth 19 for receiving the socket connector 6. The base 10 has end portions 20 projecting beyond the end walls 14 and 16 and a lateral portion 22 projecting beyond the side wall 12. There depends from each end wall 14 and 16, a pair of latch arms 24 for latching the connector 2 into a rectangular hole in a mounting panel (not shown), in co-operation with the projecting portions 20 and 22 of the base 10. Each side wall 12 and 13 has an upper edge 23 having a central cut out 25. The end wall 14 is formed with an internal keyway 26 for receiving a polarizing key, which is referred to further below, of the socket connector 6, whereby only a connector 6 having a polarizing key which can be received in the keyway 26, can be mated with the connector 2. The end wall 16 is formed with a pair of internal grooves 28 for receiving end portions of side walls of a cover, which is described below, of the connector 6.

There extend through the base 10, eighteen electrical pins 30 arranged in two rows, each of nine pine 30. Each pin 30 has a mating portion 32 upstanding from the base 10 into the receptacle 18, for mating with a respective socket terminal, described below, of the connector 6 and a connecting portion 34 extending at right angles to the portion 32, between a respective pair of barriers 36 depending from the base 10. The pin portions 34 are for insertion in respective holes in a printed circuit board (not shown) to be soldered to printed conductors thereon. The base 10 is formed with depending mounting lugs 38 for securing the connector 2 to the circuit board. The electrical pins could alternatively be rectilinear, having connecting portions depending normally from the base 10, the mounting lugs being horizontally oriented and the barriers being omitted.

There upstands from the edge 23 of each side wall 12 and 13 on a respective side of the mouth 19, a uniplanar rack 40 coplanar with the side wall from which it upstands. The racks 40 are in precise alignment with each other both longitudinally and laterally of the housing 8. Each rack 40 has a pair of superposed teeth 42 and 41, respectively, which taper longitudinally of the housing 8 and in a direction away from the side wall 16. The teeth 42 and 44 overhang the side walls 12 and 13 respectively. The tooth 42 has an outer working edge 46 an inner working edge 48 and a crest 49, the tooth 44 having an inner working edge 50 an outer working edge 51, and a crest 52.

Figure 3:
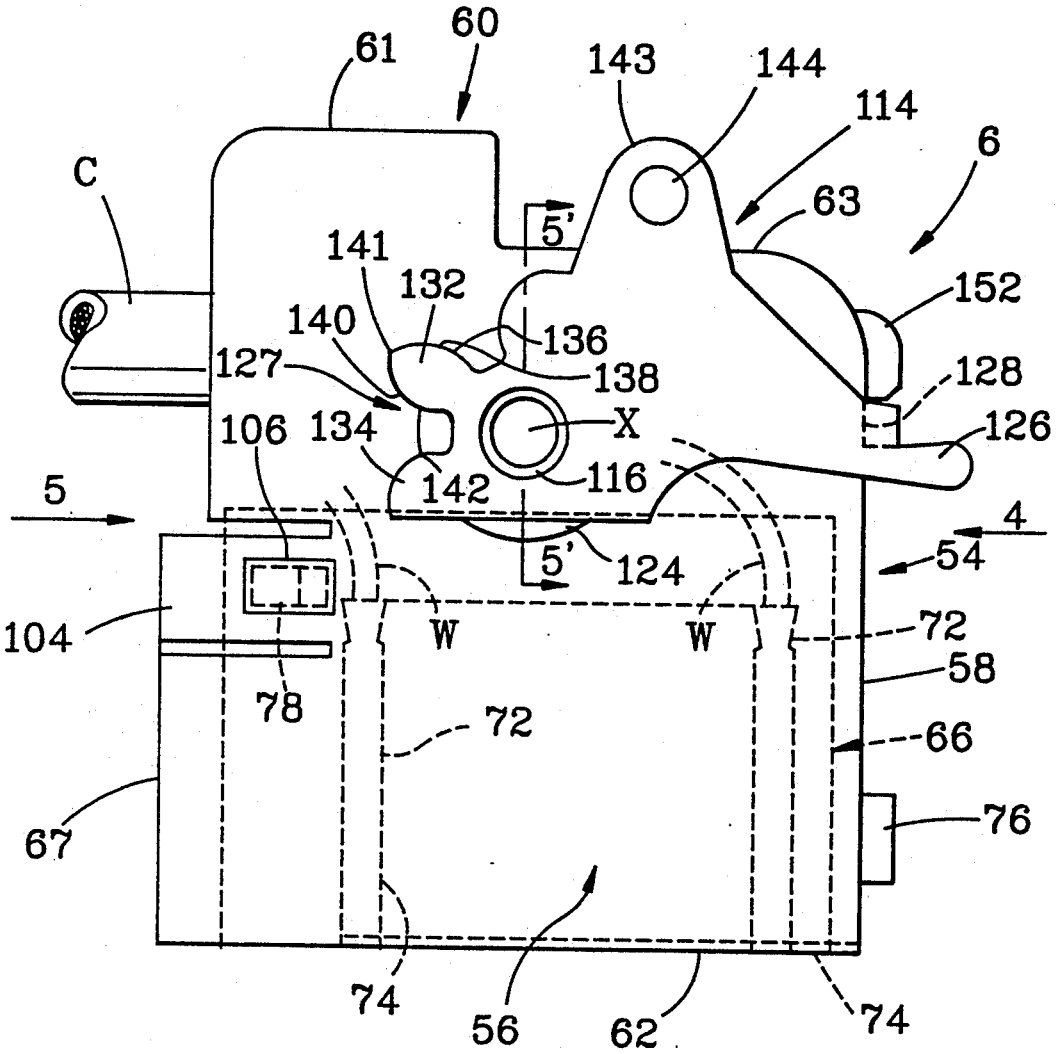
FIG. 3 is a side view of a socket connector of the assembly, for mating with the pin header connector.
Figure 4:
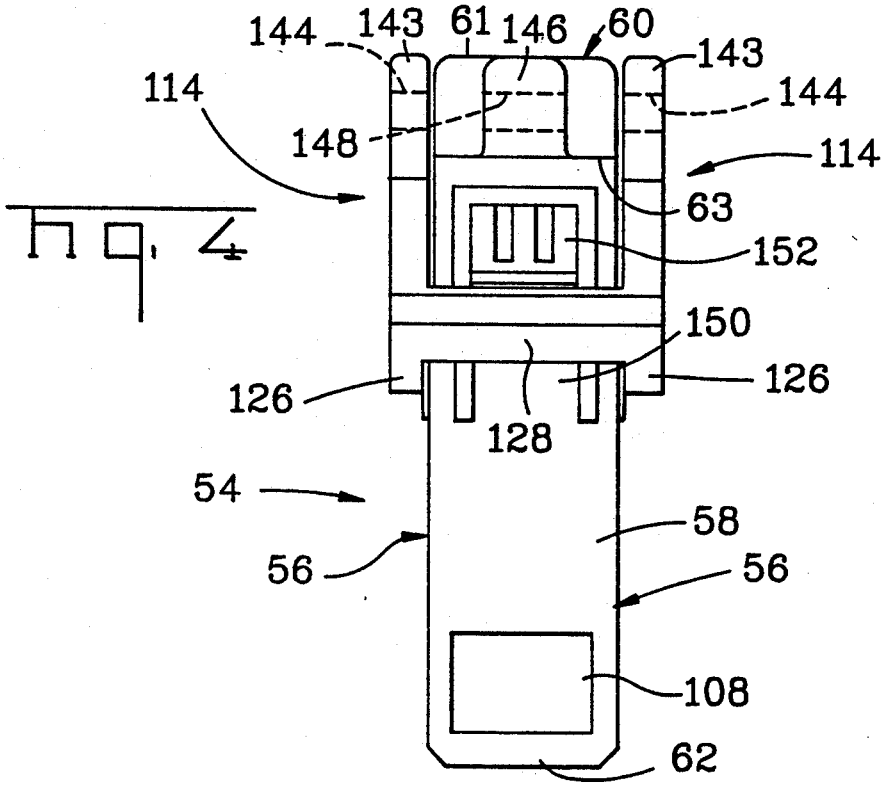
FIG. 4 is an end view of a cover of the socket connector, taken in the direction of the arrow 4 in FIG. 3.
Figure 5:
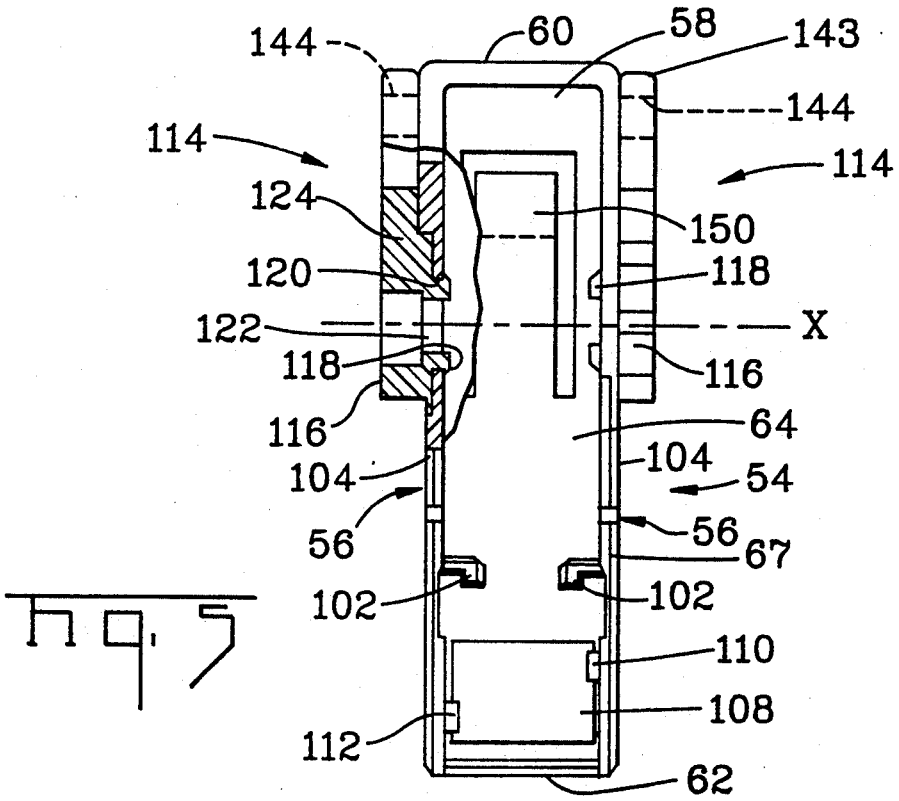
FIG. 5 is an end view of the cover taken in the direction of the arrow 5 in FIG. 3, and shown partly in section on the lines 5'—5' in FIG. 3.
Figure 6:
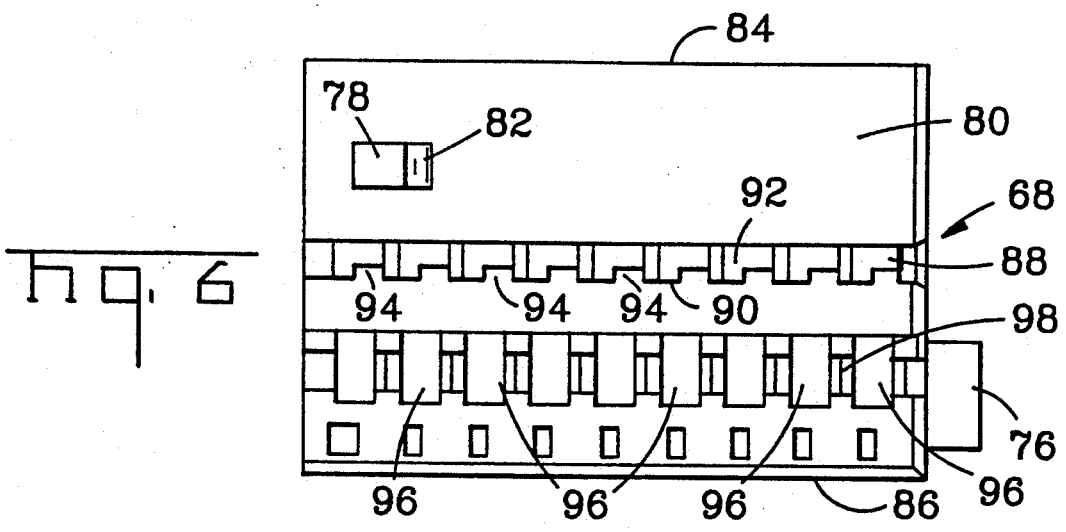
FIG. 6 is a side view of an insulating housing of a socket connector member of the socket connector.
Figure 7:
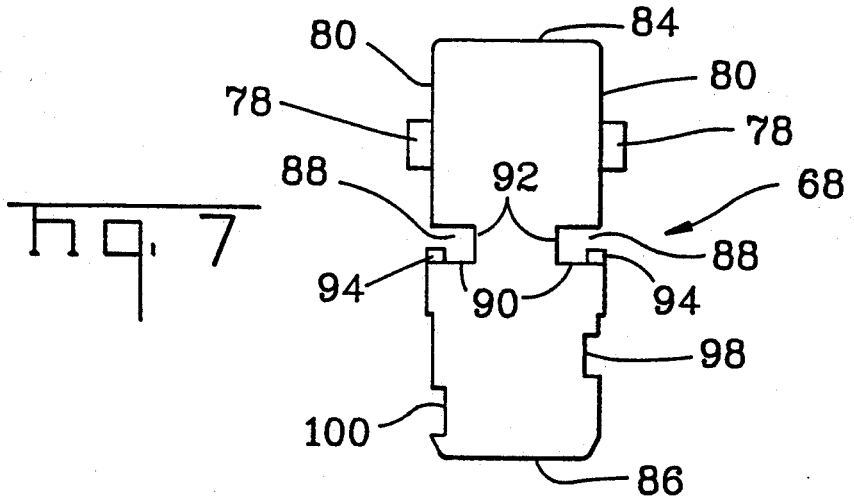
FIGS. 7 and 8 are an end view and a top plan view, respectively, of the housing of the socket connector member.
Figure 8:
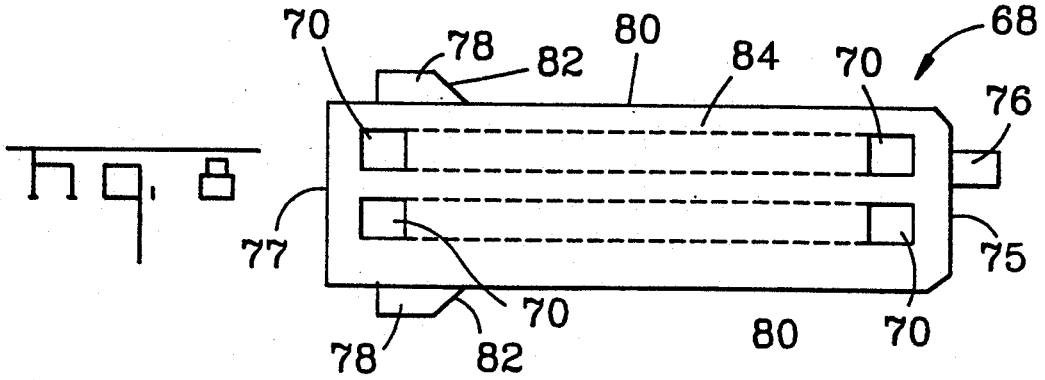

As best seen in FIGS. 3 to 5, the socket connector 6 comprises a hollow insulating cover 54 having side walls 56 connected by an end wall 58, a top wall 60 and a bottom wall 62. The top wall 60 has a raised portion 61 and a lower portion 63 stepped therebelow. Opposite to the end wall 58, the cover 54 has an open end 67. The walls 56, 58, 60 and 62 cooperate to define a substantially rectangular cavity 64 the upper end part of which receives an end portion of a multi-conductor cable C, and the lower part of which receives a socket connector member 66 which is shown in broken lines in FIG. 3, but which is not shown in FIGS. 4 and 5, which show the cover 54 only.

As shown in FIGS. 6 to 10, the connector member 66 comprises an insulating housing 68 in the form of an elongate block, defining two rows of nine through, rectangular cross section cavities 70 each receiving an electrical socket terminal 72. The terminals 72 are shown diagrammatically and in broken lines in FIG. 3. Each terminal 72 is crimped to a conductor W of the cable C. The bottom wall 62 of the cover 54 has a through opening 74 aligned with each terminal 72, for receiving a respective pin portion 32. A polarizing key 76 projects from a chamfered leading end 75 of the housing 68, the housing 68 having proximate to its opposite end 77, a pair of opposed anchoring lugs 78 provided on side walls 80 of the housing 68. Each lug 78 has a chamfered leading end surface 82 and is located towards a top wall 84 of the housing 68. The cavities 70 open into the top wall 84 and a bottom wall 86 of the housing 68.

Below the lugs 78 the housing 68 is formed with a pair of opposed, rectangular, rectilinear keyways 88 each extending into a respective one of the side walls 80. Each keyway 88 has a floor 90 and an inner end wall 92. There projects from each floor 90 in spaced relationship with the wall 92 of the respective keyway 88, a stop lug 94. Below the channel 88 therein, each side wall 80 is formed with a row of nine openings 96 each for receiving a latching tongue (not shown) on a respective terminal 72. Between the openings 96 and one of the side walls 80, are projections defining a longitudinal polarizing keyway 98 and between the openings 96 on the other side wall, are projections defining a second longitudinal keyway 100 below a keyway 98.

The side walls 56 of the cover 54 are formed with L-cross section rails 102 for engaging in the respective keyways 88, behind the stop lugs 94 of the housing 68. There projects from each side wall 56, at the open end 67 of the cover 54, a latch arm 104 having a rectangular opening 106 for receiving a respective one of the anchoring lugs 78 of the housing 68. Below the rails 102 the end wall 58 of the cover 54 is formed with a rectangular, through opening 108. Within the height of the opening 108, one side wall 56 is formed with a key 110 for receipt in the keyway 98 of the housing 68, the other side wall 56 being formed with a key 112 below the key 110 for receipt in the keyway 100 of the housing 68.

Figure 9:
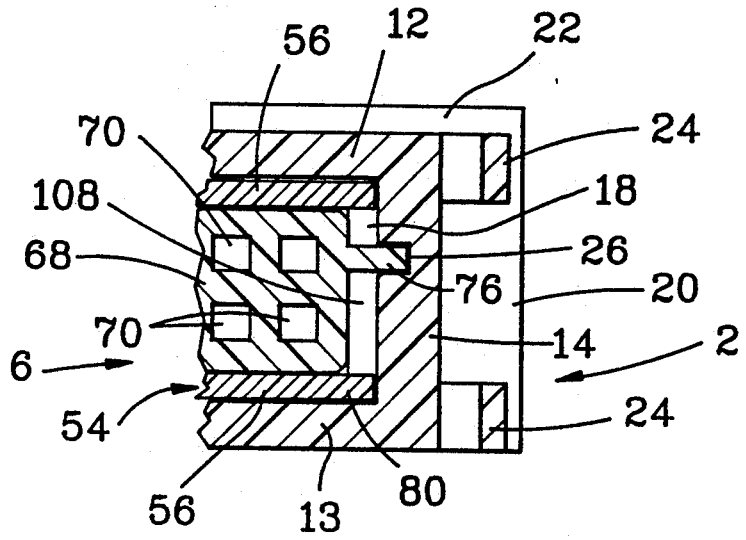
FIG. 9 is a fragmentary longitudinal sectional view of one end portion of the pin header connector and the cover and the housing of the socket connector member, when disposed in assembled relationship.

The assembly of the connector member 66 to the cover 54, will now be described. The terminals 72 having been crimped to the conductors W of the cable C and inserted into the cavities 70 so that the said locking tongues of the terminals 72 latch into the openings 96, the connector member 66 is inserted with its end 75 leading, through the open end 67 of the cover 54, the keys 102, 110 and 112 of the cover 54 being received in the respective keyways 88, 98 and 100 of the housing 68. Upon full insertion of the connector member 66 into the cover 54, the anchoring lugs 78 of the housing 68, aided by their chamfered leading surfaces 82, latch into the openings 106 of the latch arms 104 and the key 76 of the housing 68 projects through the opening 108 in the wall 58 of the cover and there beyond, as shown in FIG. 3 and 9.

In this fully inserted position of the housing 68, each of the terminals 72 is aligned with a respective opening 74 in the bottom wall 66 of the cover 54. By virtue of the polarizing key means described above, only a predetermined connector member 66, having corresponding keying means, can be assembled to the cover 54. The rails 102 and the keyways 88 serve to stabilize the connector member 66 in the cover 54. The opening 108 is greatly oversized in width relative to the key 76, being substantially coextensive in width with the end 75 of the housing 68, so that the cover 54 can receive a connector member 66 having its key 76 located at any position on the end 75 of the housing 68. The connector member 66 can be removed from the cover 54 by raising the latch arms 104 and pushing the connector member 66 out of the cover 54 by way of the opening 108.

The cover 54 further comprises a pair of external, uniplanar, levers 114, each mounted for rotation about a common axis X on a respective side wall 56. Each lever 114 comprises a hollow hub 116 from which projects a flange 118 having a peripheral groove 120 receiving an edge of a circular opening 122 in the respective side wall 56. A circular guide collar 124 of each lever 114 is countersunk into the respective side wall 56. On one side of the axis X, each lever has a handle 126. The handles 126 are ganged by means of latch bar 128. On the opposite side of the axis X to the handle 126, each lever 114 has a pinion 127 having an upper pinion tooth 130, an intermediate pinion tooth 132, and a lower pinion tooth 134. Each tooth 130 has a rounded working surface 136, each tooth 132, having opposed, rounded, upper and lower working surfaces 138 and 140, respectively, defining a crest 141. Each tooth 134 an has upper, rounded working surface 142.

Above the axis X and offset therefrom towards the handle 126 each lever 114 has an upstanding projection 143 formed with an eyelet 144 for receiving a locking rod, which is referred to below. The levers 144 are aligned with each other, the eyelets 144 of the levers being aligned with each other both longitudinally and laterally of the cover 54, thus are the handles and the respective teeth of the levers 114. There projects between the levers 114, from the lower portion 63 of the top wall 60, up to the level of the portions 61 thereof, a lug 146 formed with an eyelet 148 for receiving said stop rod. Below the wall portion 63, the end wall 58 is formed with a vertical, resilient latch arm 150 terminating at its upper end in a latch head 152 which acts in the manner of a push button as described below.

Figure 10:
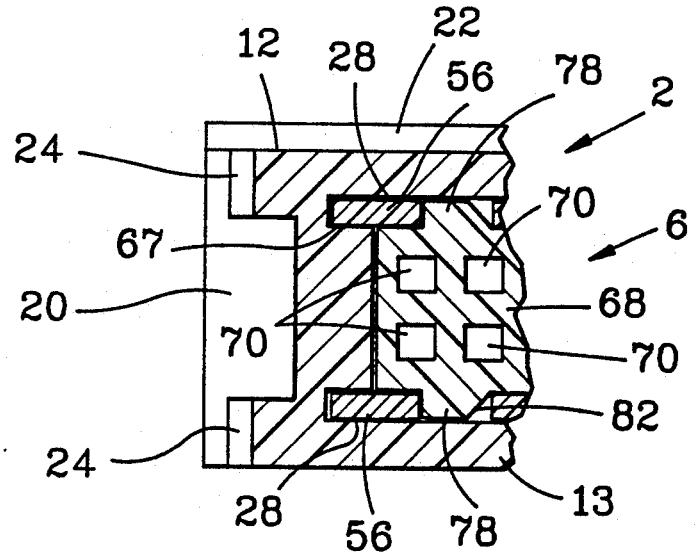
FIG. 10 is a fragmentary longitudinal sectional view of the other end portion of the pin header connector and the cover and the housing of the socket connector, in said assembled relationship.

The use of the pin header connector assembly, will now be described with particular reference to FIGS. 11 and 12. The connecting portions 34 of the pins 30 having been soldered to the printed circuit board and the mounting lugs 38 bolted thereto, the pin header connector is inserted through the hole in the panel and is latched thereinto by means of the latch arms 24 in the manner described above. With the connector 2 so installed to the panel, the connector 6 is partially mated with the connector 2, by inserting the cover 54 with its bottom wall 62 leading, into the receptacle 18, of the connector 2, so that the polarizing key 76 of the connector member 66 in the cover 54 enters the keyway 26 of the housing 8 of the connector 2 (FIG. 9) and the ends of the side walls 56 of the cover 54 at the open end 67 thereof are received in the grooves 28 of the housing 8 (FIG. 10).

Figure 11:
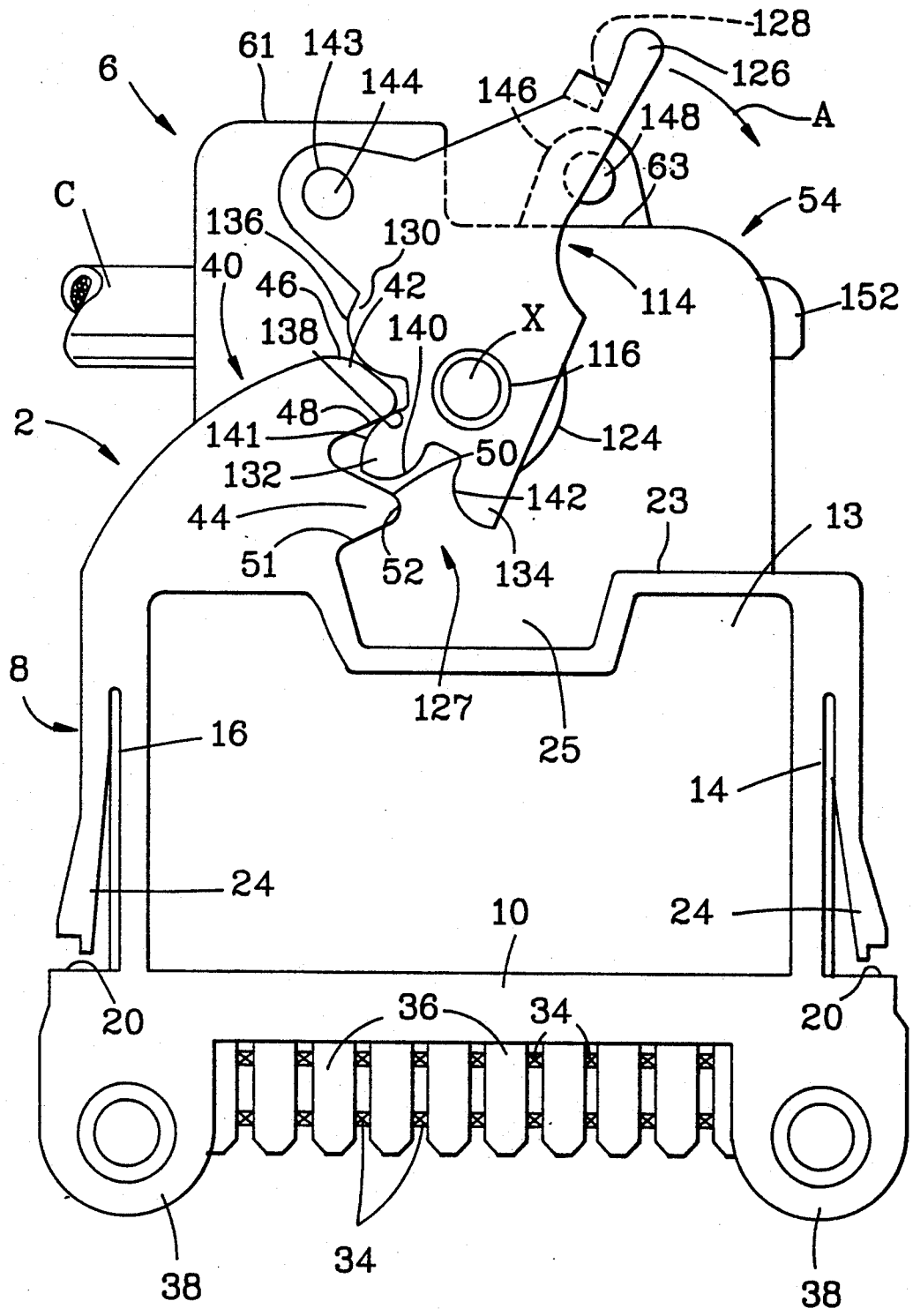
FIG. 11 is a side view showing the socket connector partially mated with the pin header connector.

As will appear from FIG. 11, the connector 6 is initially so inserted into the receptacle 18 and the levers 114 are so manipulated, that each lever 114 is angularly positioned about the axis X so that the rounded surface 136 of the tooth 130 of each lever 114 engages against the outer edge 46 of the upper tooth 42 of the corresponding rack 40 of the cover 54, the tooth 132 of each lever 114 being received between the surfaces 48 and 50 of the teeth 42 and 44 of the respective rack 40. In this angular position of the levers 114, the handles 126 are obliquely upwardly directed, the latch bar 128 lying above the latching head 152 and the eyelets 144 and 148 being out of alignment, as shown in FIG. 11.

Figure 12:
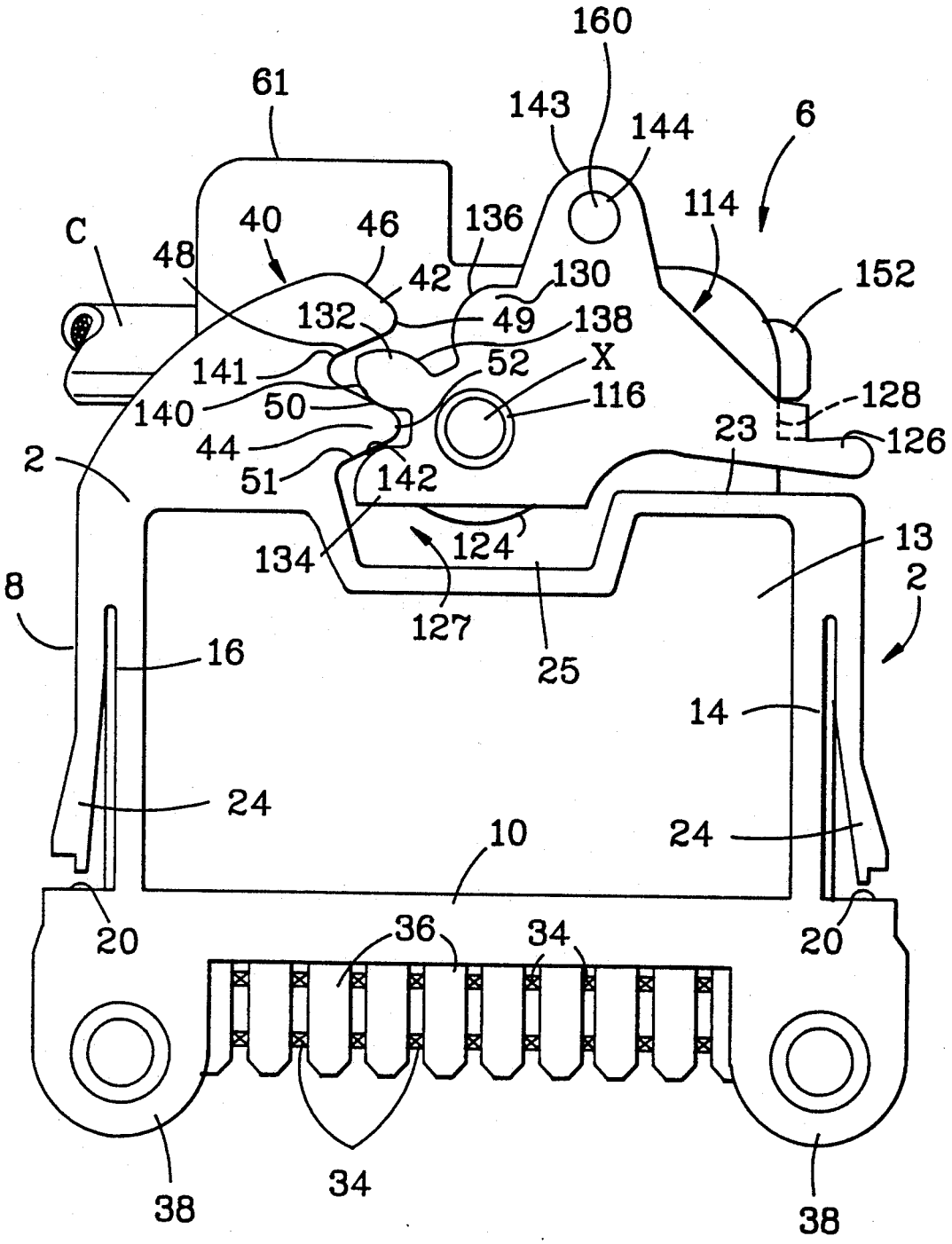
FIG. 12 is a similar view to FIG. 11 but showing said connectors when in fully mated relationship.

In order fully to mate the connectors 2 and 6, the operator depresses the handles 126 so that the levers 114 are swung in a clockwise, as seen in FIGS. 11 and 12, sense as indicated by the arrow A in FIG. 11, until the latch bar 128, having depressed the latching head 152 against the action of its latch arm 150 engages behind the head 152 as it resiles as the bar 128 passes it. The levers 114 are accordingly latched in an angular position in which the handles 126 are substantially horizontally directed as shown in FIG. 12. During the swinging movement of the levers 114, the rounded surfaces 138 of the teeth 132 slidably engage against the surfaces 48 of the teeth 42 and slide therealong whereby the connector 6 is forced down into the receptacle 18 until, as shown in FIG. 12, the crest 52 of each rack tooth 44 is received between the surfaces 140 and 142 of the corresponding pinion teeth 132 and 134, the surfaces 142 engaging against the surfaces 51 of the rack teeth 44 and the crests 141 of the pinion teeth 132 engaging against the surfaces 48 of the rack teeth 42, return movement of the levers 114 being prevented by the latch head 152. In the FIG. 12 angular position of the levers 114, the mating portions 32 of the pins 30 are fully received in the socket terminals 72, and the eyelets 144 and 148 are in alignment with each other to receive a wire 160 the ends of which can be then sealed together for preventing unauthorised tampering with the levers 114 when the connector assembly is sited, for example in a dash panel of an automobile.

The connectors 2 and 6 can readily be unmated following removal of the wire 160, by depressing the latching head 152 and returning the levers 114 in an anti-clockwise, as seen in FIGS. 11 and 12, sense so that the surface 140 of each pinion tooth 132 slidably engages against the surface 50 of the corresponding rack tooth 44 whereby the tooth 132 is fully received between the corresponding rack teeth 42 and 44, the crest 141 of the tooth 132 then sliding on the surface 50, and the surfaces 136 of the pinion teeth 130 sliding on the surfaces 46 of the rack teeth 42 until the handles 126 extend vertically thereby allowing the connector 6 to be removed from the connector 2. The cut outs 25 serve to accommodate the swinging movements of the levers 114, which remain outside the receptacle 18 throughout said swinging movements.

By virtue of the mechanical advantage afforded by the location of the axis X proximate to the pinion teeth, the connector 6 can readily be withdrawn from the connector 2 despite the frictional engagement between the eighteen pin mating portions 32 and the eighteen terminals 72. The rounded working surfaces of the pinion teeth enable sliding engagement thereof with the rack teeth, thereby ensuring smooth action of the rack and pinion mechanism.

Since the racks 40 are located above the housing 8, and are coplanar with the side walls 12 and 13 thereof, rather than being provided on those side walls, the housing 8 can be of the minimum width necessary to accommodate the connector 6, this being of particular advantage where the connector assembly or a bank of such assemblies arranged in juxtaposed relationship are to be accommodated in a confined space. In view of a smooth action of the rack and pinion mechanism, the levers 14 can, easily be operated where access thereto is very limited and where the operators view of the levers is partially or wholly obstructed.

I claim:

1. An electrical connector assembly comprising first and second mating electrical connectors, the first connector having a first insulating housing and the second connector having a second insulating housing, the first housing having side walls defining a receptacle having a mouth for receiving the second housing in mating relationship with the first housing, the side walls of the first housing being formed with a pair of opposed racks, and side walls of the second housing having thereon a pair of opposed levers each having a pinion for meshing with teeth of a respective one of the racks, the levers being swingable to drive the housings into and out of fully mating relationship, when the pinions are meshed with the racks; characterised in that each rack upstands outwardly of the mouth of the receptacle from an edge of a respective side of the receptacle, the teeth of the rack overhanging that side wall and the rack being substantially coplanar therewith.

2. An assembly as claimed in claim 1, characterised in that the levers are uniplanar and are substantially coplanar with the side walls of the receptacle when the second housing is received in the receptacle.

3. An assembly as claimed in claim 1, characterised in that the levers are positioned on the side walls of the second housing so that that the levers remain outside the receptacle throughout the swinging movements of the levers, these side walls being provided with cut outs for accommodating the pinions.

4. An assembly as claimed in claim 1, characterised in that the pinion of each lever comprises a set of pinion teeth proximate to a common axis of rotation of the levers, a handle remote from said axis and a projection upstanding from the lever between its handle and said axis, the projection being formed with an eyelet remote from said axis, the eyelets of the two levers being aligned with each other, a further projection upstanding from the second housing between the levers having a further eyelet which is so located that all of said eyelets are in alignment when the first and second housings are in their fully mated relationship to allow said eyelets to receive a common wire.

5. An assembly as claimed in claim 1, characterised in that the side walls of the second housing define a cavity for receiving an electrical connector member, the second housing having an open end and a closed end opposite thereto, each side wall of the second housing having a latch arm proximate to said open end for snap engagement with a projection proximate to one end of the connector member upon insertion thereof through said open end up to said closed end, the connector member having a polarising key at its end opposite to said one end, for engagement in a polarising keyway in said receptacle, the closed end of the second housing having an opening through which said polarising key projects when said opposite end of the connector member has been inserted up to said closed end.

6. An assembly as claimed in claim 5, characterised in that said opening is substantially coterminous in width with said opposite end of the connector member.

7. An assembly as claimed in claim 5, characterised in that the connector member has a keyway formed in each of two opposite side walls thereof, each keyway opening into each of said ends of the connector member and each of these keyways having therein a stop lug spaced from an inner end wall of such keyway, the side walls of the second housing having a pair of rectangular cross section internal keys each for engaging behind the stop lugs of a respective one of the keyways.

8. An assembly as claimed in claim 5, characterised in that the second housing has a first key on one side of said opening in said closed end and a second key, the keys on the opposite side of that opening and being offset from said first and second keys, the keys being slideably engagable in respective keyways in respective side walls of the connector member.

9. An electrical connector assembly comprising a pin header connector and a socket connector for mating therewith, the pin header connector having a first insulating housing having a pair of side walls defining a receptacle and having upper edges defining a mouth for receiving the socket connector into the receptacle in mating relationship with the pin header connector, with electrical pins of the pin header connector received in electrical socket terminals of the socket connector, the first insulating housing being formed with a pair of opposed racks, the socket connector having a second housing in the form of a cover having side walls upon which are mounted a pair of opposed levers each having a pinion for meshing with teeth of a respective one of the racks, the levers being swingable to drive the socket connector into, and out of, fully mated relationship with the pin header connector when said pinions are meshed with teeth of the racks; characterised in that each rack is formed integrally with, and upstands from, the upper edge of the respective side wall of the first housing in substantially coplanar relationship with that side wall with the rack teeth of the rack overhanging the upper edge of that side wall, the levers being so vertically positioned on the side walls of the second housing that the levers remain above the side walls of the first housing throughout the swinging movements of the levers, these side walls being provided with cut outs for accommodating the pinions, each lever being uniplanar and being substantially coplanar with the respective side wall of the first housing when the socket connector is received therein.

* * * * *